US005803238A

United States Patent [19]

Roza

[11] Patent Number: 5,803,238

[45] Date of Patent: Sep. 8, 1998

[54] DOOR OPENER SWITCH

[75] Inventor: Ivan Roza, Olten, Switzerland

[73] Assignee: Elektro-Apparatebau Olten AG

[21] Appl. No.: 651,516

[22] Filed: May 22, 1996

[30] Foreign Application Priority Data

Jun. 14, 1995 [CH] Switzerland ..... 1760/95

[51] Int. Cl.[6] ..... H01H 9/02

[52] U.S. Cl. ..... 200/332.1; 200/296; 200/339

[58] Field of Search ..... 200/296, 332.1, 200/332.2, 339

[56] References Cited

U.S. PATENT DOCUMENTS 2,451,176 10/1948 Schellman ..... 200/296 X 4,048,455 9/1977 Forsythe et al. ..... 200/332.1 X 5,164,554 11/1992 Ikunami ..... 200/339 X

*Primary Examiner*—Renee S. Luebke

*Attorney, Agent, or Firm*—Martin A. Farber

[57] ABSTRACT

A door-opener switch has a cylindrical housing and a button axially movable in the housing for actuating a switch member. The button can be depressed against the action of a restoring force. The housing is provided, between its front and rear ends, with an outwardly radially protruding collar. Each of front and rear sides of the collar forms a stop surface. The stop surfaces, resting against a mounting plate, determine a distance of the front side of the housing from a front of the mounting plate.

11 Claims, 1 Drawing Sheet

DOOR OPENER SWITCH

FIELD AND BACKGROUND OF THE INVENTION

The present invention relates to a door-opener switch having a cylindrical housing and a button movable axially within the housing for actuation of a switch member which is fastened to the housing, the button being adapted to be depressed against the action of a restoring force.

Door-opener switches require a large-area push cap with a short switch path and an extremely flat manner of construction. In order to achieve this, known switches are provided with electronic switch elements, which elements, however, are sensitive to voltage peaks; such voltage peaks are, however, frequent in the networks of public transportation systems such as railways, streetcars, trolley buses, etc., and lead to damage to the switches or to disturbances in the actuation of the door.

SUMMARY OF THE INVENTION

The object of the present invention is, therefore, to provide a flat door-opener switch having a mechanical switch member and a large-area push cap the visible side of which can furthermore be developed in an aesthetic manner within wide limits.

According to the invention the housing has, between its front and rear ends, an outwardly radially protruding collar each of the front and rear sides of which forms a stop surface, the surface determining, by application against a mounting plate, the distance of the front side of the housing from the front of the mounting plate.

Further according to the invention within the path of displacement of the button there is a transversely oriented lever which is swingable by the button around a swing bearing fixed on the housing, which lever acts by a place spaced apart from the swing bearing on the switch member, and the button contacts the lever between the bearing which is fixed on the housing and the place.

BRIEF DESCRIPTION OF THE DRAWINGS

With the above and other objects and other advantages in view, the present invention will become more clearly understood in connection with the detailed description of a preferred embodiment, when considered with the accompanying drawing of which.

DETAILED DESCRIPTION OF THE PREFERRED EMBODIMENT

Figure 1:
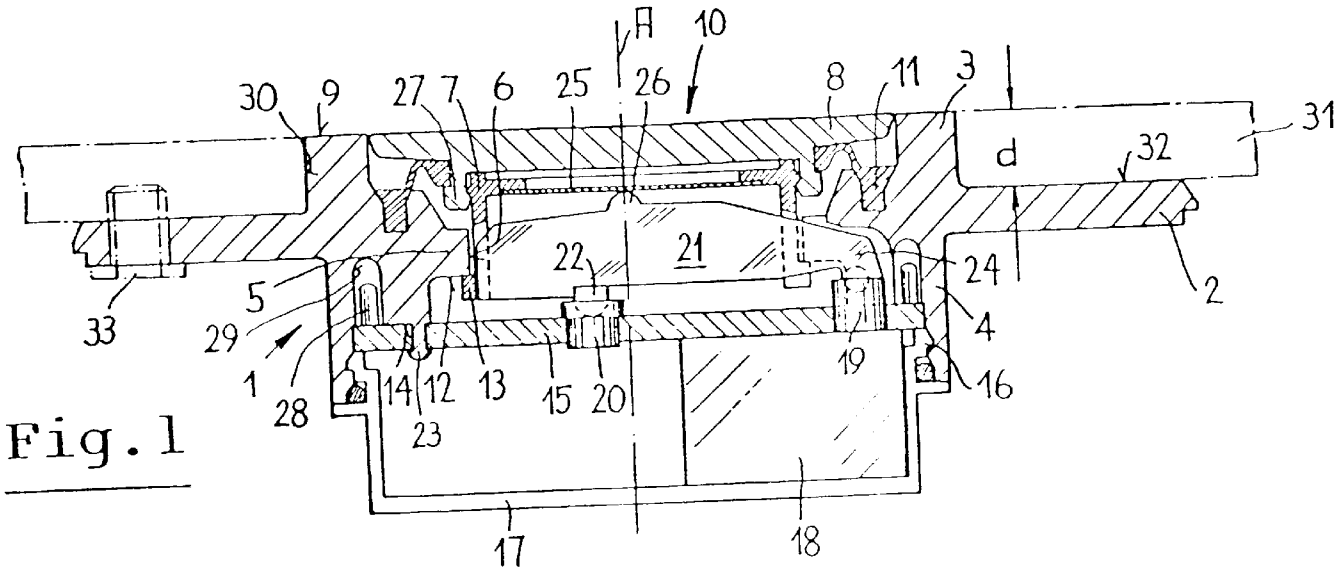
FIG. 1 is a longitudinal section through a door-opener switch which is inserted from the rear into a mounting plate.

The switch has a cylindrical housing 1 which is divided by a radially outward extending flange-like collar 2 which is axial to the longitudinal axis A of the housing into a front section 3 and a rear section 4. The outer sides of the sections 3 and 4 form surfaces which are cylindrical with respect to the housing axis A, in which connection the diameter of the outer surface of the front section 3 can be somewhat greater than the diameter of the outer surface of the rear section 4. On its inner side, the housing 1 forms an annular rib 5 which is concentric to its longitudinal axis A. The rib serves as a substantially cylindrical guide surface 6 which is coaxial to the longitudinal axis of the switch, and within which a push-cap support 7 is mounted for axial, displacement. The push-cap support 7 as a result of radial play, is tiltable about every transverse axis. A push cap 8 of larger diameter is rigidly attached to the push cap support 7, the visible side of the cap being flush with the end 9 of the housing 1 in the position of rest shown in the drawing. The push cap 8 and the push-cap support 7 constitute a button 10 which is movably connected with the housing 1 by an elastic annular membrane 11. The rear of the annular rib 5 furthermore forms a stop surface against which a circuit board 15, fastened by rivets, rests without play. The circuit board 15 bears a mechanical switch member 18 having a spring-loaded actuating projection 19 as well as a swing bearing 20 for a lever 21. The swing bearing 20 is offset laterally from the axis of the housing.

The button 10 can be depressed against the elastic restoring force of the actuating projection 19, axially into the housing 1, and/or can tilt transverse to the housing longitudinal axis A on the housing as a result of the radial play.

Furthermore, the annular rib 5 provide, on its lower side, distributed with radial symmetry, one or more stop surfaces 12. Under the action of the restoring force of the actuating projection 19 transmitted by the lever 21, radially outward protruding stops 13 of the push-cap support 7 rest against one or more of the stop surfaces 12 when the button 10 assumes its position of rest. In this connection, the force of reaction of the elastically deformed annular membrane 11 can be superimposed on the restoring force of the actuating projection 19.

The rear of the housing 1 is closed by a closure cap 17 which is fastened in form-locked manner on the housing 1 by detent projections 16. The housing 1 is preferably developed as an anti-pull-out device for the connecting cable.

A spherical protrusion 22 of the lever 21 is supported in the spherical cup of the swing bearing 20 and the end 24 of the lever rests on the actuating projection 19. The protrusion 22 and the swing bearing 20 form a ball or universal joint. Between the push cap 8 and the lever 21, there diametrally extends a Bellevue spring 25 which is fastened to the push-cap support 7 and against which there rests a rounded projection 26 of the lever 21 which is coaxial to the axis A of the housing. The projection 26 forms a tilt axis for the button 10 and lies between the swing bearing 20 and the end 24 of the lever. A ratio a/b of the lever arms is so selected that the switch path established for the push cap 8 is only a fraction of the switch path, established for the actuating projection 19. As switch member 18, an ordinary, well-proven mechanical microswitch can be used.

The stroke of the button 10 is limited by the annular rib 5 which engages between the stops 13 and an annular rib 27, present, on the rear of the push cap. By this limiting of the stroke of the button 10, the Bellevue spring 25, the spring path of which is larger than the maximum stroke, protects the switch member 18 from mechanical overload if too great a force is exerted on the push cap 8. The force exerted on the projection 26 is merely the product of the distance moved over by the push cap 8 multiplied by the spring constant of the Bellevue spring 25; it is reduced up to the actuating projection 19 furthermore in accordance with the lever-arm ratio a/b.

In order that the push cap 8 can be made of a comparatively large diameter and can be actuated with substantially the same force at any place, the push-cap support 7 is, as mentioned, mounted with play within the annular rib 5.

Thereby the button 10 is not only displaceable in axial direction of the housing 1 and in the direction of the lever 21, but is also tiltable around every axis oriented transversely to the longitudinal axis which is formed by the projection 26 or the universal joint 20, 22. If an actuating force now acts on the edge of the push cap, the stop 13 remains resting against the stop surface 12 on the opposite side of the push cap 8. As a result, the push cap 8 swings about an axis of swing formed by the stop surfaces 12 and 13 and by means of the Bellevue spring 25 which rests against the projection 26. Thereby, movement of the push cap 8 depresses the lever 21.

If the housing 1 is made of a light-transmitting, preferably glass-clear material, the circuit board 15 can be provided with a ring of diodes 28 which illuminates the circular front side 9 of the switch and improves the visibility of the push cap 8 for the user, or indicates the operating state of the switch to the user. The diodes of the ring of diodes 28 are contained in corresponding recesses 29 in the housing 1.

In FIG. 1 the switch is inserted without play from the rear into a hole 30 in a mounting plate 31 shown in dot-dash line. In order that the front side 9 of the housing 1 is flush with front side of said plate, the forward-directed surface of the collar 2, which rests from the rear against the mounting plate 31, is set back by the thickness "d" of the mounting plate 31 behind the front side 9. The collar 2 is screwed from the rear, by means of screws 33, against the mounting plate 31. If necessary, the distance between the surface 32 and the front side 9 can be adapted to the thickness "d" of the mounting plate 31 by inserting spacer rings between the collar 2 and the mounting plate 31.

Figure 2:
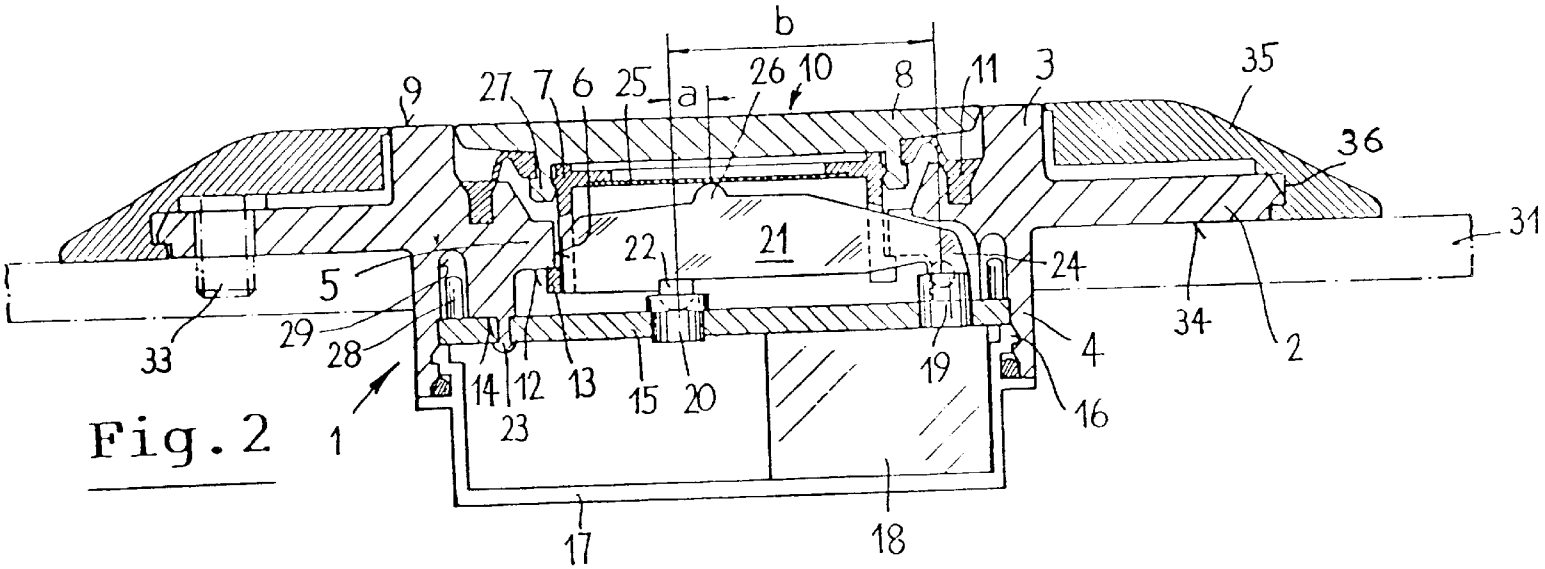
FIG. 2 is a view similar to FIG. 1, in which the door-opener switch is inserted from the front into a mounting plate and is covered by a rosette.

With the type of mounting shown in FIG. 2, the housing 1 is inserted from the front into a hole 30 in a mounting plate 31, and the rear surface 34 of the collar 2 is screwed against the front side of the mounting plate 31. The collar 2 is covered by a rosette 35 which is secured in undetachable manner to it, as by a detent 36, and which can be imparted any aesthetic development desired and, by its shape or color, increases the visibility of the push cap 8.

I claim:

1. A door-switch comprising:

a cylindrical housing, a switch member fastened to the housing, and a button movable axially within the housing for actuation of the switch member;

wherein the button is adapted to be depressed against a restoring force;

the housing has, between front and rear ends, an outwardly radially protruding collar comprising a front side facing outwardly of a door upon which the door-switch is mounted and a rear side opposite the front side, a mounting plate of the door contacting the front side of the collar;

each of the front and rear sides of the collar forms a stop surface, the stop surfaces determining, by application against the mounting plate of the door a distance of a front side of the housing from a front of the mounting plate;

the housing is configured with a radially symmetrical outer surface; and the collar has the form of a flange, and the collar has detent fastening means for engagement with a rosette which, in engaged condition, surrounds a front of the housing with radial symmetry and covers the collar.

2. A door-opener switch comprising:

a cylindrical housing, a switch member rigidly fastened to the housing, and a button movable axially within the housing in a direction of a longitudinal axis of the housing for actuation of the switch member;

wherein the button is held by a restoring force in a position of rest and is adapted to be depressed against action of the restoring force;

the door-opener switch further comprises a lever oriented transversely of the longitudinal axis, a swing bearing fixed to the housing, and a place of action by the lever in operation of the door opener switch;

the lever is located within a path of displacement of the button, the lever being swingable by the button around the swing bearing;

the place of action is spaced from the swing bearing on the switch member, and the button contacts the lever between the bearing and the place of action; and in a region of its longitudinal center axis, the button contacts the lever at a place of contact, the button being swingable around the place of contact.

3. A door-opener switch according to claim 2, wherein the swing bearing is a universal joint, and the button is mounted in the housing tiltable with the lever in any of plural directions around the swing bearing.

4. A door-opener switch according to claim 3, wherein the button has a push cap, and a push-cap support which is guided with radial play in the housing; and in a position of rest of the button, the push-cap support rests, spaced from the push cap, with radially symmetrically distributed stops on stop surfaces fixed on the housing, and is held resting against the stops by the restoring force.

5. A door-opener according to claim 2, further comprising a restoring spring present in the switch member, and an actuating projection extending from the switch member; and wherein the restoring force is applied by the restoring spring switch member and acts on the actuating projection.

6. A door-opener switch according to claim 5, wherein the button has a push cap and a push-cap support which is guided with radial play in the housing; and in a position of rest of the button, the push-cap support rests, spaced from the push cap, with radially symmetrically distributed stops on stop surfaces of the housing, and is held resting against the stops by the restoring force.

7. A door-opener switch according to claim 2, wherein the button has a spring by which the button acts on the lever at the place of contact.

8. A door-opener switch according to claim 7, wherein the path of axial displacement of the button is limited by stops, and a maximum length of the path of displacement is less than a spring path of the spring.

9. A door-opener switch according to claim 2, further comprising a circuit board which holds the swing bearing, and is fixed on the housing as well as to the switch member, the circuit board being positioned transversely to the path of displacement of the button.

10. A door-opener switch according to claim 9, wherein the circuit board is fastened, free of play, in the housing.

11. A door-opener switch according to claim 9, wherein the housing comprises light-transmitting material, the circuit board comprises light-emitting diodes in a region of a wall of the housing, and the housing wall is provided with recesses to receive the light-emitting diodes.

* * * * *